US010610035B2

(12) United States Patent
McIver et al.

(10) Patent No.: US 10,610,035 B2
(45) Date of Patent: Apr. 7, 2020

(54) SPREADING DEVICE

(71) Applicant: Champions of Butter, Inc., Annan (CA)

(72) Inventors: Andrew McIver, Annan (CA); Irwin Eydelnant, Toronto (CA); Brandon Geller, Toronto (CA); Chao-Kai Jen, St. Catharines (CA)

( * ) Notice: Subject to any disclaimer, the term of this patent is extended or adjusted under 35 U.S.C. 154(b) by 105 days.

(21) Appl. No.: 15/559,679

(22) PCT Filed: Mar. 3, 2016

(86) PCT No.: PCT/CA2016/050228
§ 371 (c)(1),
(2) Date: Sep. 19, 2017

(87) PCT Pub. No.: WO2016/149801
PCT Pub. Date: Sep. 29, 2016

(65) Prior Publication Data

US 2018/0303261 A1 Oct. 25, 2018

(30) Foreign Application Priority Data

Mar. 20, 2015 (CA) ..... 2885436

(51) Int. Cl.
*A47G 19/00* (2006.01)
*A47G 19/18* (2006.01)
(Continued)

(52) U.S. Cl.
CPC ..... *A47G 19/303* (2013.01); *A47G 19/183* (2013.01); *A47G 19/186* (2013.01);
(Continued)

(58) Field of Classification Search
CPC .. A47G 19/303; A47G 19/183; A47G 19/186; A47G 19/18; A47G 19/12;
(Continued)

(56) References Cited

U.S. PATENT DOCUMENTS 2,139,084 A * 12/1938 Larsen ..... B43K 5/06 401/160
2,478,122 A 8/1949 Mossel
(Continued)

FOREIGN PATENT DOCUMENTS

CA 1151466 8/1983
CA 1188120 6/1985
(Continued)

OTHER PUBLICATIONS

Communication: Extended European Search Report, dated Oct. 25, 2018. EP Application No. 16767568.5/3270742. pp. 1-7.
(Continued)

*Primary Examiner* — David J Walczak
(74) *Attorney, Agent, or Firm* — Harris Beach, PLLC; Neal L. Slifkin

(57) ABSTRACT

A spreading device comprises a container comprising a dispensing end and an exterior surface, and at least one gripping or handling surface extending from the container for gripping or handling the spreading device, squeezing or applying pressure against the exterior surface of the flexible container, and causing the dispensing of a spreadable substance out of the dispensing end of the container.

21 Claims, 14 Drawing Sheets

(51) Int. Cl.

| | |
|---|---|
| ***A46B 11/00*** | (2006.01) |
| ***B65D 75/32*** | (2006.01) |
| ***B65D 85/72*** | (2006.01) |
| ***B65D 85/74*** | (2006.01) |
| ***B65D 75/56*** | (2006.01) |

(52) U.S. Cl.
CPC ..... *B65D 75/326* (2013.01); *B65D 75/563* (2013.01); *B65D 85/72* (2013.01); *B65D 85/74* (2013.01); *A46B 11/001* (2013.01); *A47G 19/18* (2013.01)

(58) Field of Classification Search
CPC ..... B65D 75/326; B65D 85/72; B65D 85/74; B65D 75/563; B65D 77/245; B65D 75/305; B65D 75/325; B05C 17/002; B05C 17/005; A46B 11/0006; A46B 11/001; A46B 11/002; A46B 11/0041
See application file for complete search history.

(56) References Cited

U.S. PATENT DOCUMENTS

| | | | | |
|---|---|---|---|---|
| 2,565,874 | A | | 8/1950 | Mossel |
| 2,527,149 | A | | 10/1950 | Peterson |
| 2,691,877 | A | | 10/1954 | Frolich |
| 2,730,878 | A | | 1/1956 | Incorvaia |
| 2,750,767 | A | | 6/1956 | Von Knauf et al. |
| 2,811,844 | A | | 11/1957 | Selmer |
| 2,814,868 | A | | 12/1957 | Wellinger |
| 3,003,180 | A | | 10/1961 | August |
| 3,005,225 | A | | 10/1961 | Faust et al. |
| 3,299,464 | A | | 1/1967 | O'Brien et al. |
| 3,315,801 | A | | 4/1967 | Lowry |
| 3,545,873 | A | | 12/1970 | Isaf |
| 3,652,171 | A | | 3/1972 | Carlson |
| 3,735,487 | A | | 5/1973 | Wojcik |
| 3,741,384 | A | | 6/1973 | Cloud |
| 3,826,259 | A | * | 7/1974 | Bailey ..... A61M 35/006 604/310 |
| D243,059 | S | | 1/1977 | Hoffschneider et al. |
| 4,301,762 | A | | 11/1981 | Burnett, Jr. |
| 4,360,020 | A | | 11/1982 | Hitchcock, Jr. et al. |
| 4,408,919 | A | * | 10/1983 | Wolff ..... A47G 19/303 222/142.1 |
| D272,796 | S | | 2/1984 | Wolff |
| 4,701,168 | A | * | 10/1987 | Gammons ..... A61M 35/006 604/1 |
| D407,275 | S | | 3/1999 | Foster |
| 6,071,029 | A | * | 6/2000 | Weinstock ..... A46B 11/0041 401/153 |
| 6,340,097 | B1 | * | 1/2002 | D'Alessio ..... A61M 35/003 215/12.2 |
| D530,990 | S | | 10/2006 | Wangler |
| 7,396,176 | B2 | | 7/2008 | Schoemer |
| 7,658,566 | B2 | | 2/2010 | Wangler |
| 8,747,007 | B2 | * | 6/2014 | Krcma ..... A21C 15/005 222/566 |
| 2009/0148571 | A1 | | 6/2009 | Reda |

FOREIGN PATENT DOCUMENTS

| | | | |
|---|---|---|---|
| CA | 2304346 | | 10/2000 |
| CA | 2619122 | A1 | 9/2007 |
| CA | 2670195 | A1 | 2/2010 |
| CA | 2720766 | C | 9/2013 |
| WO | 2005039992 | A1 | 5/2005 |
| WO | 2014126515 | A1 | 8/2014 |

OTHER PUBLICATIONS

File History for U.S. Appl. No. 12/315,738.
PCT Search Report and Written Opinion for PCT/CA/2016/050228 dated May 4, 2016 (May 4, 2016).

* cited by examiner

SPREADING DEVICE

CROSS-REFERENCE TO RELATED APPLICATIONS

This application is a national stage application under 35 U.S.C. § 371 of PCT Application No. PCT/CA2016/050228, filed Mar. 3, 2016, which claims priority to and the benefit of Canadian Application No. 2,885,436 filed on Mar. 20, 2015, which are incorporated herein by reference in their entirety.

TECHNICAL FIELD

The present invention relates to spreading devices and in particular relates to spreading devices for applying spreadable substances to surfaces.

BACKGROUND

Effective application of spreadable substances, such as applying butter to hot corn, has been a problem for decades. The problem that exists with butter knives and hot corn was acknowledged as early as 1946 in U.S. Pat. No. 2,478,122 to Max N. Mossel: "the wasteful messiness of using a knife to apply the butter" (Col. 1, lines 13-14). Similarly, in U.S. Pat. No. 2,750,767 to Emil W. Von Knauf ("Von Knauf"): "the butter commences to melt and slide down the corn out of control of the butter knife" (Col. 1, lines 18-20).

This spreading problem is not limited to applying butter to hot corn. Difficulty in applying spreads to other surfaces—such as applying cream cheese to bagels or jam to bread—can occur when knives are used. For example, the use of a knife in these situations may result in clumpy or uneven distribution of a spreadable substance. In addition, the use of, for example, a pointed applicator for dispensing edible (e.g., honey) or non-edible (e.g., glue) spreadable substances may similarly result in uneven distribution, particularly where the applicator itself is impractical to use for spreading or the use of a knife would be impractical in the circumstances.

While various solutions for applying spreadable substances have been described in the prior art, such solutions are deficient in various ways.

Von Knauf discloses a spreading device for applying butter to hot corn. The Von Knauf device attempts to confine the butter as it is being applied and allows the user to manually press the butter towards the corn to facilitate spreading.

The device handle (3, 25) and the butter press (18, 30) are two separate features. Operation of the device is described as follows: "The operator, holding the spreader at the flange 3, can then press his finger at the center of the butter holder, thus pressing the flour flaps 18 downwardly and pressing the cardboard bottom 19 downwardly to force the butter into contact with the ear of corn" (Col. 2, lines 60-64). Such operation is disadvantageous in that a user would use one hand to perform multiple functions (i.e., fingers to hold the device and a finger to press at the butter holder), thus requiring a certain degree of coordination. In other words, a level of coordination is required to operate the device because the holding and pressing actions are controlled independently.

In addition, in order to confine the butter in the spreading device, Von Knauf employs tabs (12). The butter, or other spread, must be forced past the tabs and into the compartment (6) of the spreading device. However, given the tabs are moveable to allow movement of the butter (see Col. 2, lines 55-58), spreads such as butter may unintentionally leave the compartment during use. This may occur as a result of a user pressing on the butter holder to a sufficient degree so as to allow the butter to escape, either because the tabs moving outwardly and allow the butter to escape, or because the force applied to the butter holder is sufficient enough that the tabs 11 are insufficient to contain the butter, particularly since the tabs 12 only cover a limited surface area of the compartment. Alternatively, this may occur as a result of a spread being pressed towards a hot surface, the spread then melting, and tabs 12 no longer confining the spread within the compartment of the spreading device, even in cases where reduced or no force is applied to the butter holder, again recognizing that this problem is aggravated by the fact that the tabs 12 only cover a limited surface area of the compartment.

A "Butter Storing and Spreading Device" was disclosed in 1970 by Asad F. Isaf in U.S. Pat. No. 3,545,873 ("Isaf"). The main object of Isaf is to effectively store a spreadable patty in a sanitary manner. This object is accomplished by placing a cover 24 over the spread. Before applying the spread, the cover is removed. With the cover removed and the spread ready for spreading, there is no feature to allow a user to press a finger or other structure against the butter, as there is a base (14) of heavy paper or cardboard between the butter and the device handles (22). This may result in less flexibility with respect to the manner in which the butter is spread. In addition, with the cover removed, there is no feature that confines the spread within the spreading device. Accordingly, the spread may not remain in place once the spreading device is inverted, or the spread may be more susceptible to separation from the spreading device.

A similar device to Isaf was disclosed by Ronald F. Reda in United States Patent Publication No. 2009/0148571 titled "Disposable Spreading Device for Edible Spreadable Compounds" ("Reda"). One difference between Isaf and Reda is that Reda discloses that the spread is fixed to the spreading device, such that the spread remains in place when the device is inverted.

However, Reda, like Isaf, does not include a feature to allow a user to press a finger or other structure against the butter, as there is a body (120/320) comprising a handle (110/310) such that a user would hold the handle with their fingers and slide the device along, for example, a cob of corn. This may result in less flexibility with respect to the manner in which the butter is spread.

In addition, Reda fails to disclose a container to enclose the spread when the device is in the storage configuration. Rather, Reda uses a protective paper (160/360) that does not cover the edges of the spread, which may result in contamination issues during distribution and storage. While Reda does disclose a method of packaging multiple spreading devices together, a method of packaging or storing a single spreading device in a sanitary fashion (e.g., in a completely enclosed fashion) is not disclosed.

An additional, alternative and/or improved spreading device is desirable.

SUMMARY

In accordance with the present disclosure there is provided a spreading device comprising a container comprising a dispensing end and an exterior surface, and at least one gripping or handling surface extending from the container and comprising a proximal end that is proximal to the container, and a distal end that is distal to the container. The at least one gripping or handling surface may be positioned in a spreading position such that when in the spreading position at least a portion of the distal end of the at least one gripping or handling surface at least partially covers or contacts the exterior surface of the container.

Also in accordance with the present disclosure there is provided a spreading device comprising a container comprising a dispensing end and an exterior surface, and at least one gripping or handling surface extending from the container and comprising a proximal end that is proximal to the container, and a distal end that is distal to the container. The at least one gripping or handling surface is of a minimum length such that when the at least one gripping or handling surface is bent, flexed, pivoted or folded in the direction of the exterior surface of the container at least a portion of the distal end of the at least one gripping or handling surface is able to come in contact with at least a portion of the exterior surface of the container.

Also in accordance with the present disclosure there is provided a spreading device comprising a container comprising a dispensing end and an exterior surface, and at least one gripping or handling surface extending from the container for gripping or handling the spreading device, squeezing or applying pressure against the exterior surface of the flexible container, and causing the dispensing of a spreadable substance out of the dispensing end of the container.

In a further embodiment, the at least one gripping or handling surface may be positioned in a storage position such that when in the storage position at least a portion of the distal end of the at least one gripping or handling surface at least partially covers the dispensing end of the container.

In a further embodiment, the at least one gripping or handling surface comprises a first gripping or handling surface and a second gripping or handling surface.

In a further embodiment, the first gripping or handling surface and the second gripping or handling surface extend from the container in opposite directions.

In a further embodiment, the first gripping or handling surface and the second gripping or handling surface at least partially contact one another when in the spreading position.

In a further embodiment, the at least one gripping or handling surface comprises one or more bendable or flexible points, folding or pivoting edges, or hinges.

In a further embodiment, the at least one gripping or handling surface comprises one or more functional tear-offs.

In a further embodiment, the dispending end of the container forms a convex surface.

In a further embodiment, the dispending end of the container forms a substantially flat surface.

In a further embodiment, the dispending end of the container forms a concave surface.

In a further embodiment, there is a removable layer substantially covering the dispending end of the container.

In a further embodiment, the removable layer comprises one or more functional tear-offs.

In a further embodiment, there is a filter that at least partially covers the dispending end of the container.

In a further embodiment, the filter is partially or fully removably attached to the spreading device.

In a further embodiment, the filter is permanently secured to the spreading device.

In a further embodiment, the filter is flexible.

In a further embodiment, the filter is rigid.

In a further embodiment, the filter comprises a plurality of holes or apertures.

In a further embodiment, the filter comprises a plurality of bristles.

In a further embodiment, the filter and the at least one gripping or handling surface are a single, unitary component of the spreading device.

In a further embodiment, the container is made from a flexible, compressible or bendable material.

In a further embodiment, the container is made from plastic film.

In a further embodiment, the container is made from soft plastic.

In a further embodiment, the container is made from a combination of aluminum and plastic.

In a further embodiment, there is a spreadable substance located within the container.

In a further embodiment, the spreadable substance is substantially protected from contamination when in the container.

In a further embodiment, the spreadable substance is edible.

In a further embodiment, the spreadable substance is non-edible.

In a further embodiment, the spreadable substance is a granular substance.

In a further embodiment, the container is removable from the spreading device.

In a further embodiment, the container is re-attachable to the spreading device.

In a further embodiment, the container when attached to the spreading device is attached using one or more of the following: tongue and groove; and, sticker and/or adhesive.

In a further embodiment, the container is a rectangular prism.

In a further embodiment, the container is dome-shaped.

In a further embodiment, the container is cylindrical.

In a further embodiment, the container comprises collapsible concentric cylinders.

In a further embodiment, the container is cylindrical and comprises a concentric ridge extending into the container.

In a further embodiment, the spreading device comprises a toppings pouch.

In a further embodiment, the toppings pouch is fastened to the exterior surface of the container.

In a further embodiment, the toppings pouch is located or fastened between the at least one gripping or handling surface and the dispensing end.

In a further embodiment, the spreading device comprises an embedded electronic component for tracking shelf-life.

BRIEF DESCRIPTION OF THE DRAWINGS

Features, aspects and advantages of the present disclosure will become understood from the following detailed description, taken in combination with the appended drawings, in which.

DETAILED DESCRIPTION

Figure 1:
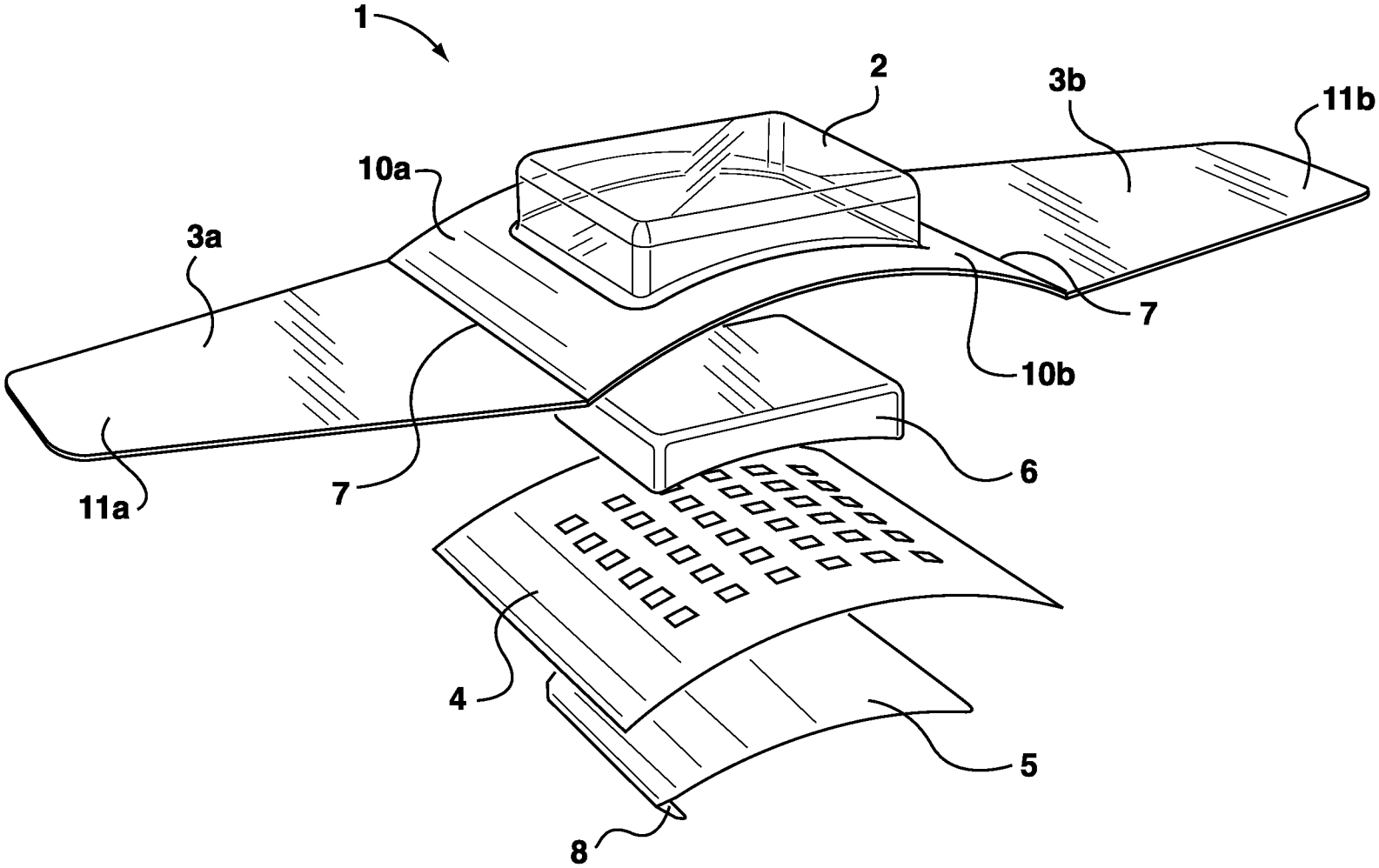
FIG. 1 is a perspective exploded view of a spreading device in accordance with the present invention.

FIGS. 1-29 will be used to describe the claimed invention. These figures depict possible embodiments of the present invention, but are not intended to limit the scope of the claimed invention. That is, the scope of the invention is defined by the claims.

Generally, the spreading device may comprise a container and at least one gripping or handling surface. With reference to the embodiment depicted in FIGS. 1-6, the spreading device 1 may comprise: a container 2; two gripping or handling surfaces or wings 3*a*, 3*b*; a filter or grate 4; and, a removable layer or sticker 5. Preferably, the gripping or handling surfaces 3*a*, 3*b* are at least partially flexible or bendable, and extend from the container. In addition, the gripping or handling surfaces 3*a*, 3*b* may comprise proximal ends 10*a*, 10*b* and distal ends 11*a*, 11*b*. Proximal ends 10*a*, 10*b* are proximal to the container 2. Distal ends 11*a*, 11*b* are distal to the container 2. Filter 4 and gripping or handling surfaces 3*a*, 3*b* may be made of a flexible or rigid material, or some combination of both. Preferably, filter 4 and gripping or handling surfaces 3*a*, 3*b* are made of plastic for durability and avoidance of degradation, tearing or deformation. Alternatively, filter 4 and gripping or handling surfaces 3*a*, 3*b* may be made of a metallic material, a durable paper material or another sufficiently durable material. Also shown is a spreadable substance 6. The spreadable substance 6 may comprise a substance that is edible, such as butter, margarine, jam, cream cheese or another edible spreadable substance. Alternatively, the spreadable substance 6 may comprise a non-edible substance, such as deodorant, nail polish remover, soap, moisturizer, glue, paint, pharmaceutical cream (e.g., for rash or burn) or another non-edible spreadable substance. In the further alternative, the spreadable substance 6 may comprise toothpaste or another non-food cream or product for health or beauty purposes.

In the further alternative, the spreadable substance 6 may comprise a granular substance, such as salt or pepper, whereby the spreading device 1 may be used as, for example, a shaker. When the device 1 is in use as a shaker, the gripping or handling surfaces 3*a*, 3*b* are held by the user and the spreading device 1 may be held over the spreading surface and shaken to dispense the granular spreadable substance 6 through the filter 4 and onto the spreading surface. The skilled person will understand that, where the spreadable substance 6 is a granular substance, a removable layer 5 may be required in order to prevent premature dispensing of the granular spreadable substance 6.

Figure 2:
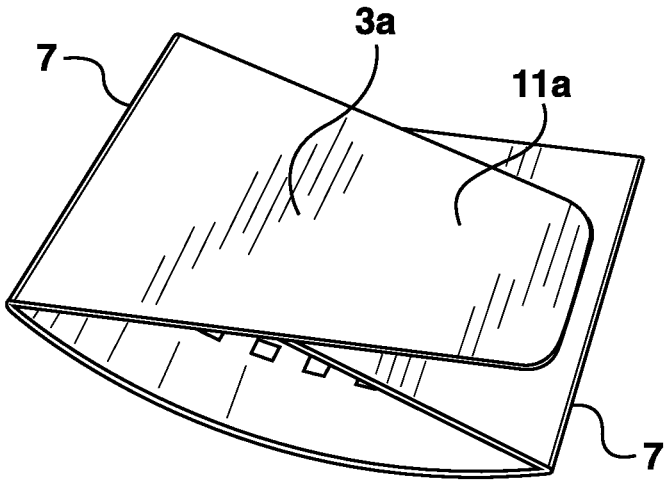
FIG. 2 is a perspective view of the bottom of the spreading device of FIG. 1 in accordance with the present invention when in a storage position.
Figure 3:
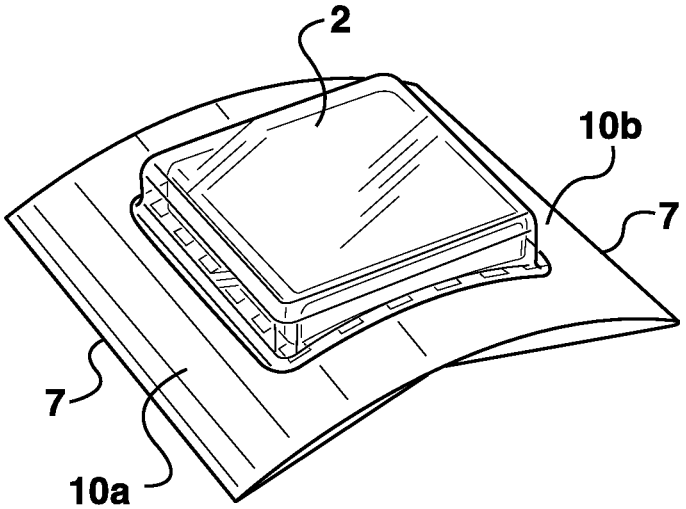
FIG. 3 is a perspective view of the top of the spreading device of FIG. 1 in accordance with the present invention when in a storage position.
Figure 4:
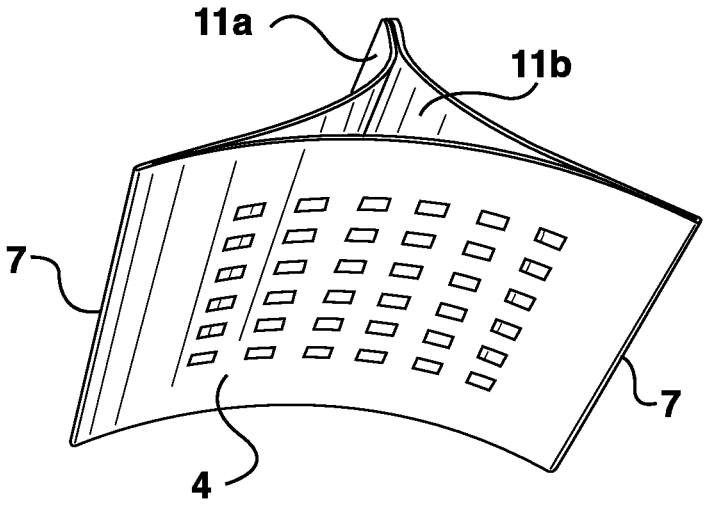
FIG. 4 is a perspective view of the bottom of the spreading device of FIG. 1 in accordance with the present invention when in a spreading position.
Figure 5:
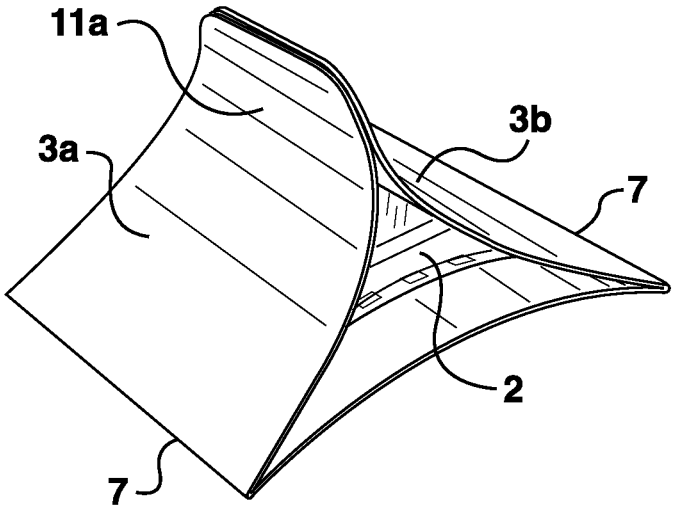
FIG. 5 is a perspective view of the top of the spreading device of FIG. 1 in accordance with the present invention when in a spreading position.
Figure 6:
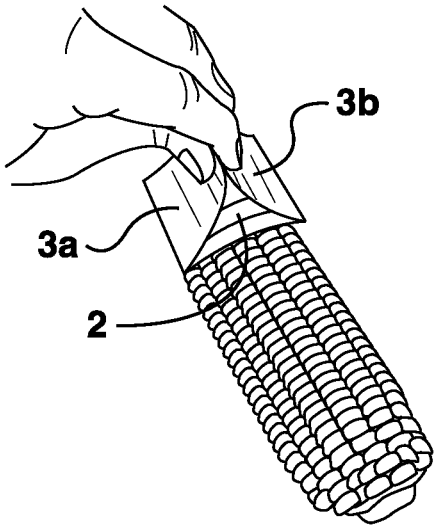
FIG. 6 is a perspective view of a spreading device in accordance with the present invention when in use on a cob of corn.

The spreading device is depicted as having a top (as shown in FIGS. 3 and 5) and a bottom (as shown in FIGS. 2 and 4). The spreading device has at least two configurations or positions: a storage position as shown in FIGS. 2 and 3, and a spreading position as shown in FIGS. 4, 5 and 6.

In the storage position, the container 2 may be visible and exposed at the top of the spreading device, as is shown in FIG. 3. The container 2 may be formed of a clear or transparent material, or an opaque or semi-opaque material. Such material for container 2 may comprise a plastic film or other flexible, compressible or bendable material made from plastic and/or paper. Preferably, the material for container 2 is relatively less thick or more deformable than the material for the gripping or handling surfaces 3*a* and 3*b* and the filter 4.

Still in the storage position, the at least one gripping or handling surface may cover at least a portion the bottom of the spreading device. At the bottom of the spreading device is a dispensing end or outlet of the container. Preferably, as shown in FIG. 2, the gripping or handling surfaces 3*a* and 3*b*, including distal ends 11*a*, 11*b*, are positioned to at least partially cover removable layer 5, filter 4 and the dispensing end of container 2. Also preferably, as shown in FIG. 2, the gripping or handling surfaces 3*a* and 3*b* are positioned to at least partially cover or overlap one another.

The storage position as described may allow for compact packaging, distribution, storage, shelving and/or efficient use of space with respect to the spreading device. In addition, the storage position may allow for sanitary distribution and storage of the spreading device because the spreadable substance 6 located in container 2 is not exposed to the surrounding environment. Rather, the spreadable substance 6 within the container 2 may be covered or protected at least in part by the filter 4 and the gripping or handling surfaces 3*a* and 3*b*, and substantially sealed inside the container 2 by the removable layer 5 and the material of container 2 itself. The spreading device as described may therefore reduce the chances of contamination of the spreadable substance when the spreading device is not in use, such as when it is in the storage position.

When it is desired to apply the spreadable substance to a surface, the spreading device may be moved from the storage position to the spreading position. The spreading position is achieved by moving the at least one gripping or handling surface from the storage position to a position such that at least a portion of the at least one gripping or handling surface may cover at least a portion of the top of the spreading device. Preferably, at least a portion of the at least one gripping or handling surface may cover or contact at least a portion the top of the container 2. With particular reference to FIG. 5, the gripping or handling surfaces 3*a* and 3*b* are positioned to at least partially cover the top of the container 2. Preferably, the gripping or handling surfaces 3*a* and 3*b*, including distal ends 11*a*, 11*b*, are positioned to be able to at least partially cover and contact an exterior surface of the container 2, as depicted in FIGS. 4 and 5. Also preferably, as shown in FIG. 5, the gripping or handling surfaces 3*a* and 3*b*, including distal ends 11*a*, 11*b*, are positioned to at least partially contact one another.

Preferably, the at least one gripping or handling surface extending from the container has a minimum length such that when it is bent, flexed, pivoted or folded in the direction of the exterior surface of the container at least a portion of the at least one gripping or handling surface is able to come in contact with at least a portion of the exterior surface of the container.

In order to facilitate the bending, flexing, pivoting or folding of the at least one gripping or handling surface, bendable/flexible points, folding/pivoting edges or hinges may be provided. The bendable/flexible points, folding/pivoting edges or hinges may be provided in order to facilitate movement of the at least one gripping or handling surface from the storage position to the spreading position, and vice versa. Preferably, the bendable/flexible points, folding/pivoting edges or hinges comprise integrated flexible plastic pivot edges 7. In the alternative to bendable/flexible points, folding/pivoting edges or hinges, the at least one gripping or handling surface may be made from a material that is generally flexible or bendable.

Figure 7:
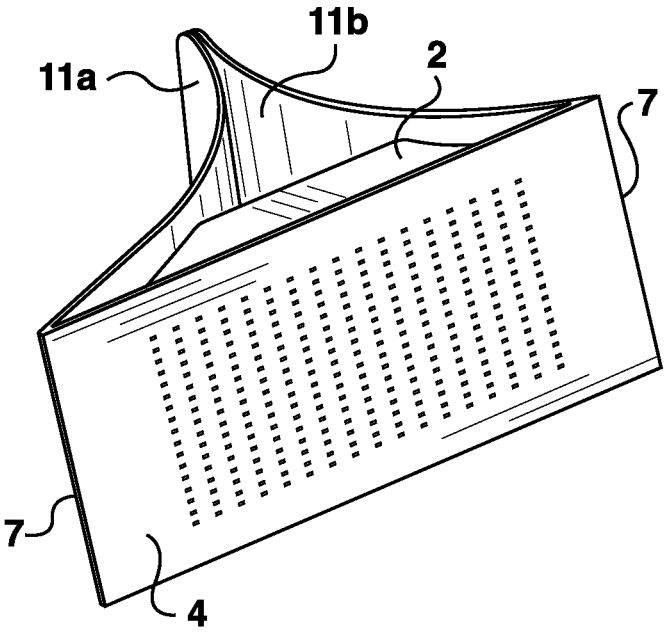
FIG. 7 is a perspective view of the bottom of a spreading device in accordance with the present invention when in a spreading position.
Figure 8:
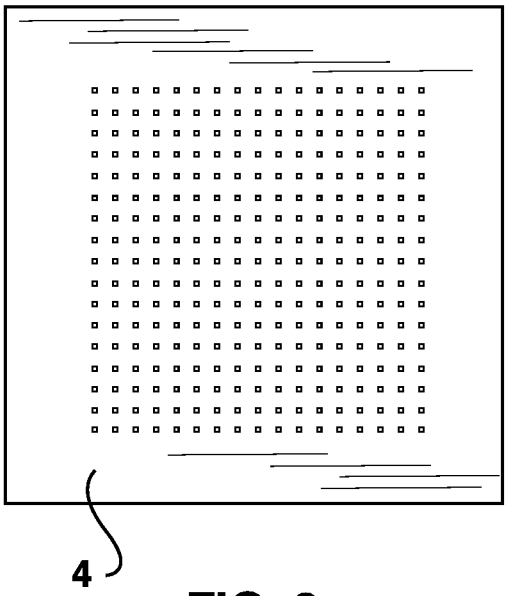
FIG. 8 is an isometric bottom view of the spreading device of FIG. 7 in accordance with the present invention when in a spreading position.
Figure 9:
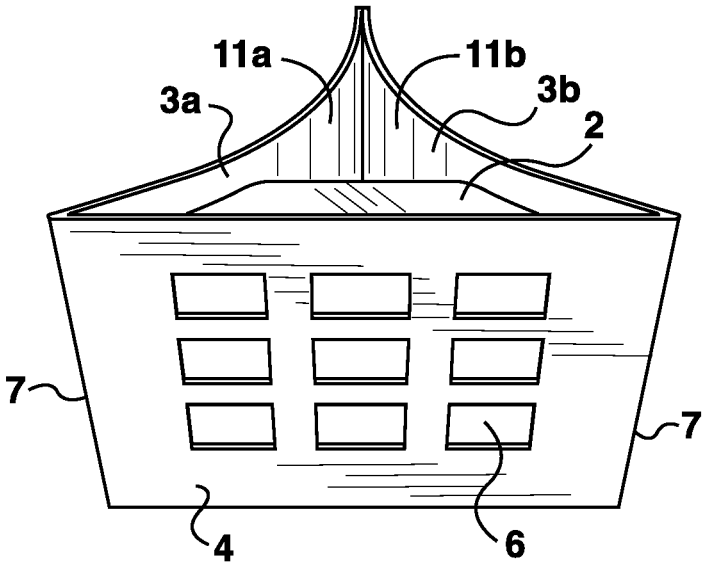
FIG. 9 is a perspective view of the bottom of a spreading device in accordance with the present invention when in a spreading position.
Figure 10:
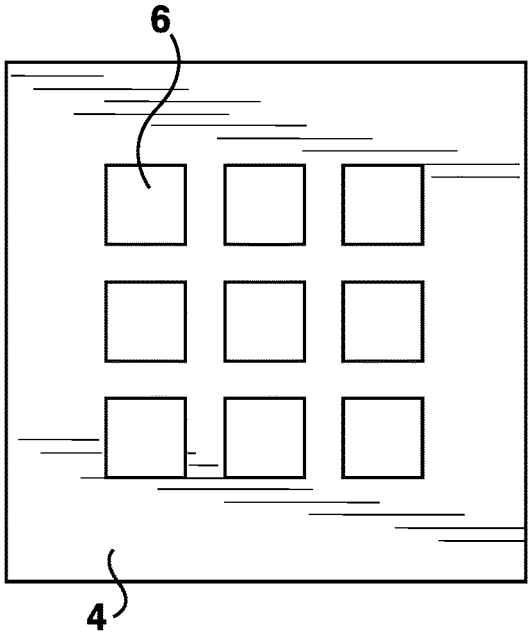
FIG. 10 is an isometric bottom view of the spreading device of FIG. 9 in accordance with the present invention when in a spreading position.

As shown in FIGS. 1 and 4, the filter 4 may comprise holes, perforations or apertures through which a spreadable substance 6 may pass or flow. It is understood and appreciated that the number, shape and/or arrangement of holes, perforations or apertures may be varied. For example, a filter comprising a relatively greater number of relatively smaller holes may adequately confine the spreadable substance 6 to the container 2 during storage while at the same time allowing adequate flow of the spreadable substance 6 out of the container 2 during use. FIGS. 7 and 8 depict a spreading device embodiment having a filter 4 comprising a relatively greater number of relatively smaller holes. Similar storage and use performance may also be achieved using a filter having a relatively fewer number of relatively larger holes. FIGS. 9 and 10 depict a spreading device embodiment having a filter 4 comprising a relatively smaller number of relatively larger holes. The nature of a particular spreadable substance 6, including the solidity vs. liquidity or hardness vs. softness of the substance, would be understood to possibly influence the number, shape and/or arrangement of holes or apertures of the filter (e.g., relatively more liquid or soft substances may require less total surface area of holes or apertures, and conversely relatively more solid or hard substances may require more total surface area of holes or apertures).

Figure 11:
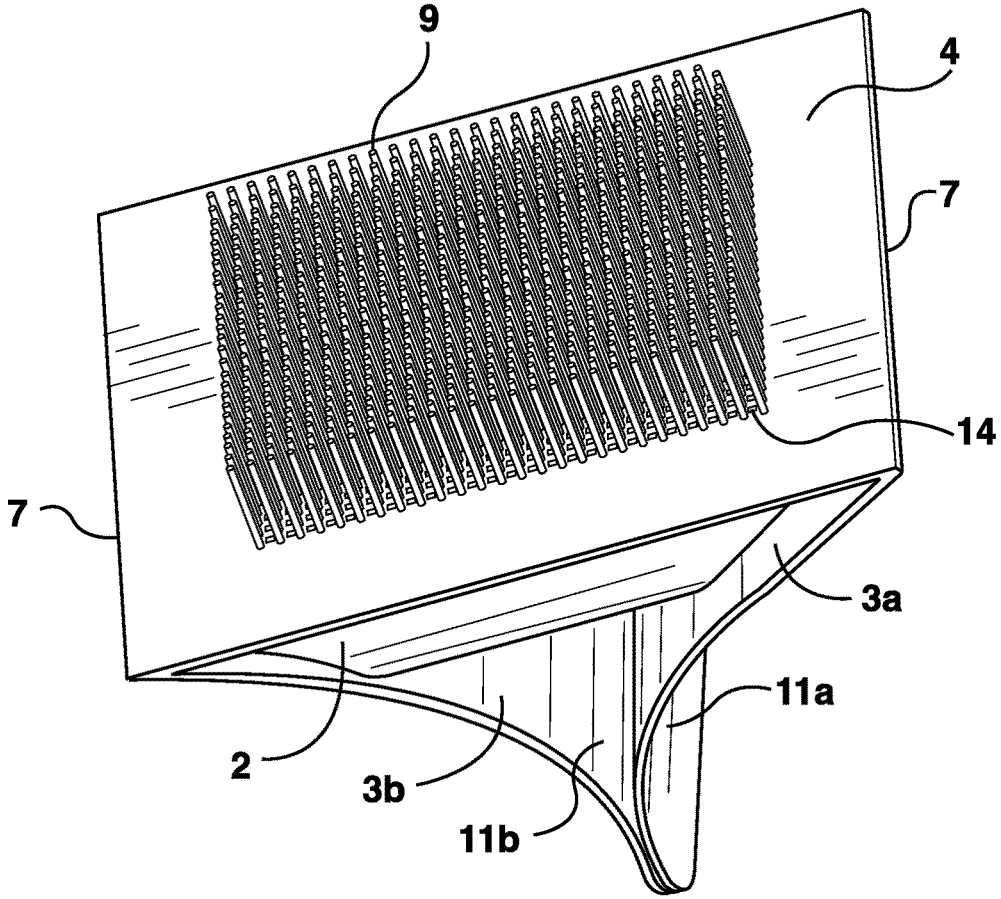
FIG. 11 is a perspective view of the bottom of a spreading device (bottom facing up) in accordance with the present invention when in a spreading position.
Figure 12:
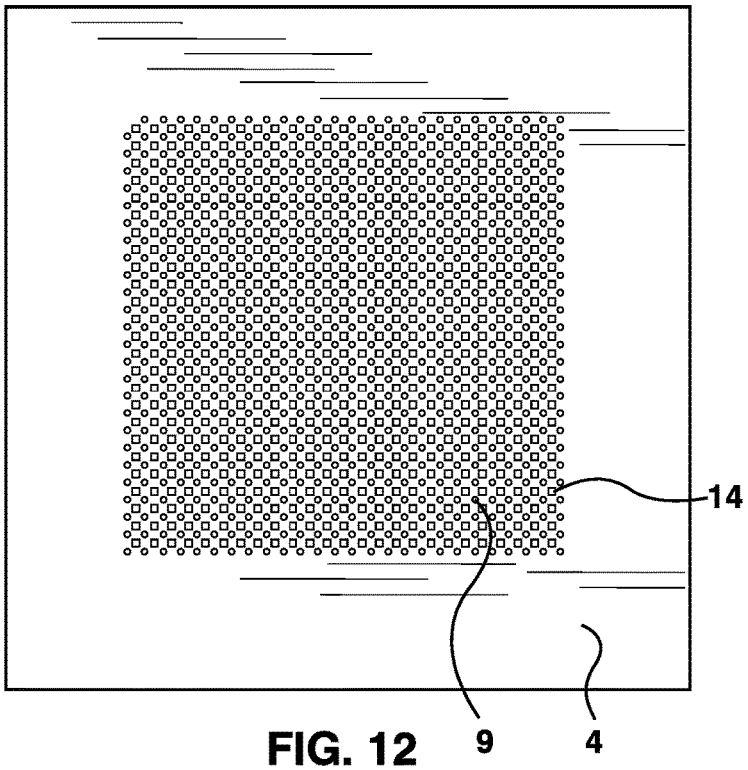
FIG. 12 is an isometric bottom view of the spreading device of FIG. 11 in accordance with the present invention when in a spreading position.
Figure 13:
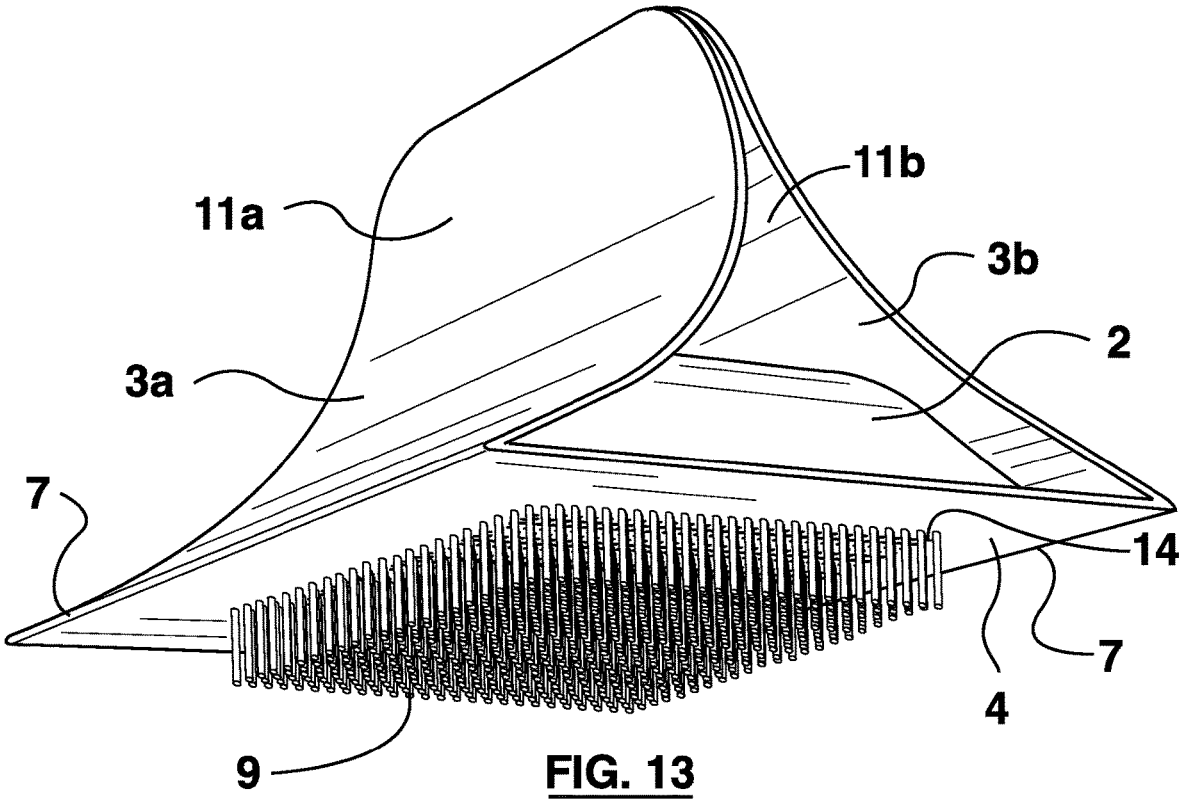
FIG. 13 is a perspective view of the bottom and side of the spreading device (bottom facing down) of FIG. 11 in accordance with the present invention when in a spreading position.
Figure 14:
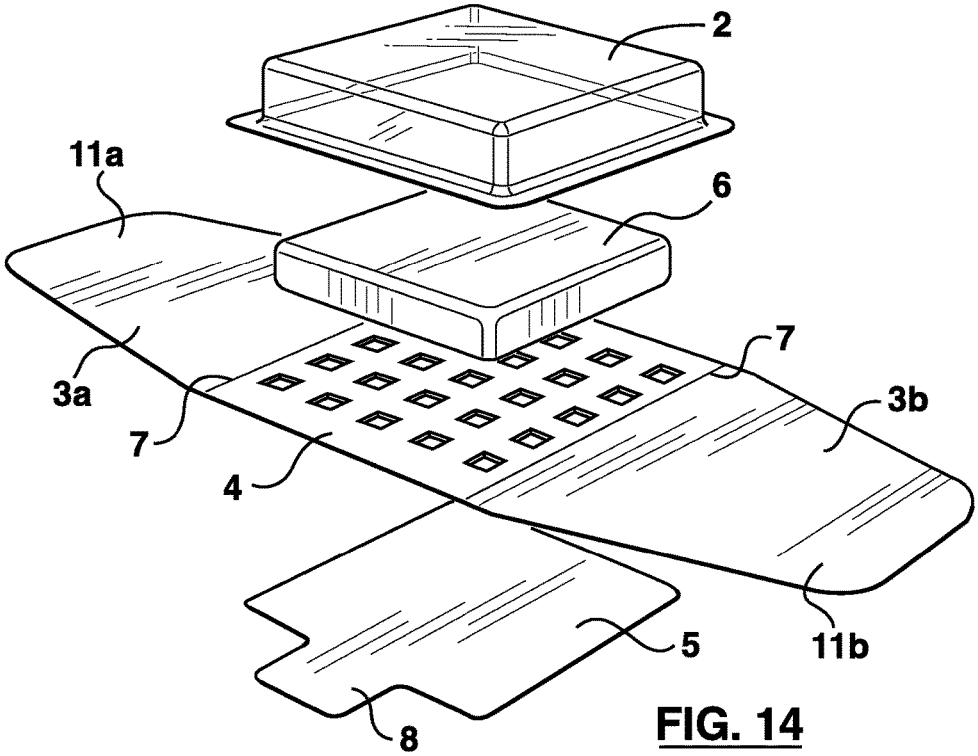
FIG. 14 is a perspective exploded view of a spreading device in accordance with the present invention.
Figure 15:
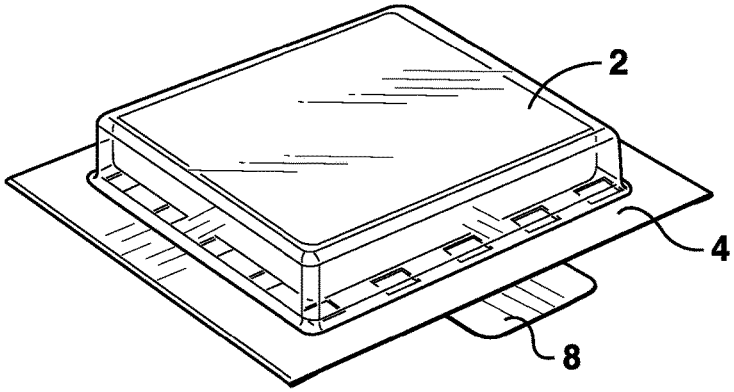
FIG. 15 is a perspective view of the top of the spreading device of FIG. 14 in accordance with the present invention when in a storage position.
Figure 16:
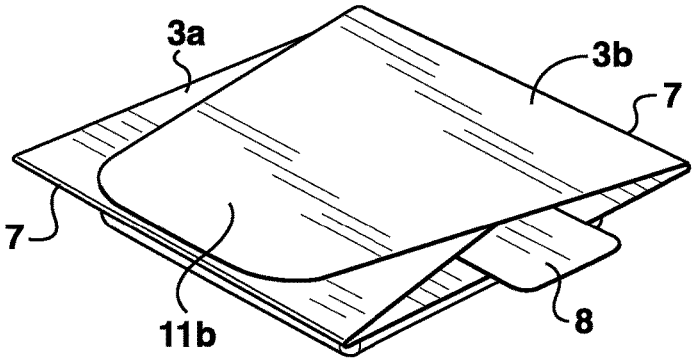
FIG. 16 is a perspective view of the bottom of the spreading device of FIG. 14 in accordance with the present invention when in a storage position.
Figure 17:
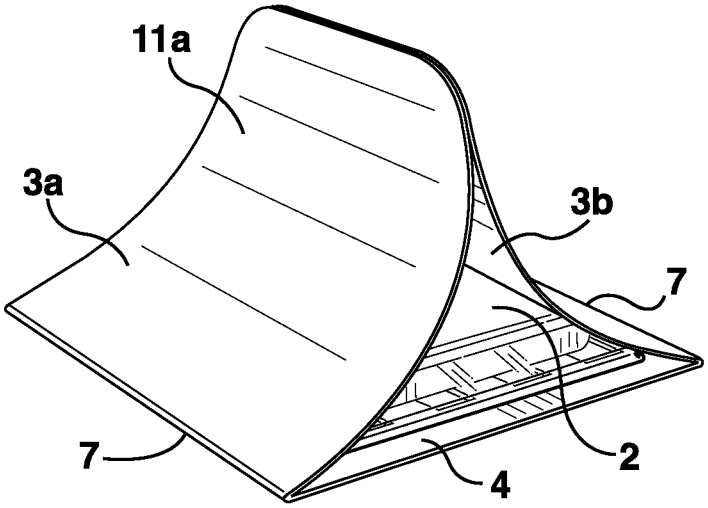
FIG. 17 is a perspective view of the top of the spreading device of FIG. 14 in accordance with the present invention when in a spreading position.

In another embodiment as depicted in FIGS. 11, 12 and 13, it may be preferable for the filter 4 to include a brush having a plurality of bristles 9. Preferably, a plurality of holes or perforations 14 in the filter 4 are spaced evenly relative to one another and located in between individual bristles of the brush 9. It would generally be understood that a brush 9 having a relatively significant number or size of bristles covering a relatively significant amount of the surface area of the filter 4 will correspondingly have more and/or smaller holes or perforations 14 than if a brush 9 has a relatively less significant number or size of bristles covering a relatively less significant amount of the surface area of the filter 4. In the latter case, a greater number of and/or larger holes or perforations may be possible. In any case, it would be understood that various sizes, combinations, configurations and arrangements of bristles and holes would be possible. In this regard, the number and/or size of bristles relative to the number and/or size of holes or perforations may vary and may be influenced at least in part by the viscosity of the spreadable substance. For example, if the spreadable substance is a thick glue, then the holes or perforations would be relatively larger and the bristles arranged differently as compared to possible arrangements when the holes or perforations are relatively smaller. Bristle size, including thickness and length, may also vary, and is preferably selected so as to most advantageously apply the intended spreadable substance.

As noted above, the spreading device may include a removable layer or sticker 5. If the spreading device 1 includes a removable layer 5, then prior to use of the device (i.e., prior to applying the spreadable substance 6 to a surface) a user should remove the removable layer 5. The removable layer 5 acts as a contamination barrier. That is, it is a sanitary layer that may be included for protection of the spreadable substance 6 during the period in which the device is not in use, such as when it is in the storage position. The removable layer may be a sticker or other thin adhesive material, and/or may be made of paper and/or plastic material. Preferably, the removable layer 5 comprises a small tab or free surface 8, as depicted in FIGS. 1 and 14-16, that may be grasped by a user for facilitating removal of the removable layer 5. Preferably, the sticker or thin adhesive characteristics of the removable layer allow it to be re-attached to the spreading device following use of the device.

The spreading device of the present disclosure may, in whole or in part, be provided in different shapes. FIGS. 1-6 depict a spreading device having a concave dispensing surface (i.e., the bottom of the spreading device, including the filter, is concave). Such a concave dispensing surface may be advantageous for applying a spreadable surface to a rounded surface, such as a cob of corn (as depicted in FIG. 6). Additionally or alternatively, the shape of the spreading device or the dispensing surface thereof may be provided as flat, convex, bent or some combination of the foregoing. For example, above-noted FIGS. 7-13 depict a substantially flat dispensing surface. Moreover, FIGS. 14-19, which are described as follows, also depict a substantially flat dispensing surface. Such a flat dispensing surface may be advantageous for applying a spreadable substance to a flat or significantly flat surface, such as bread/toast, meats or pastries.

An alternative embodiment is depicted in FIGS. 14-19. The description of the embodiment described above with respect to FIGS. 1-6 is generally applicable to the alternative embodiment of FIGS. 14-19, except that the gripping or handling surfaces 3*a*, 3*b* and the filter 4 of the embodiment of FIGS. 14-19 are a single component (whereas they were two separate components as depicted in FIGS. 1-6). As noted above, the single, unitary component comprising the gripping or handling surfaces 3*a*, 3*b* and the filter 4 as depicted in FIGS. 14-19 are preferably made of plastic for durability and avoidance of degradation, tearing or deformation. Alternatively, the gripping or handling surfaces 3*a*, 3*b* and the filter 4 may be made of a metallic material, a durable paper material or another sufficiently durable material.

Figure 18:
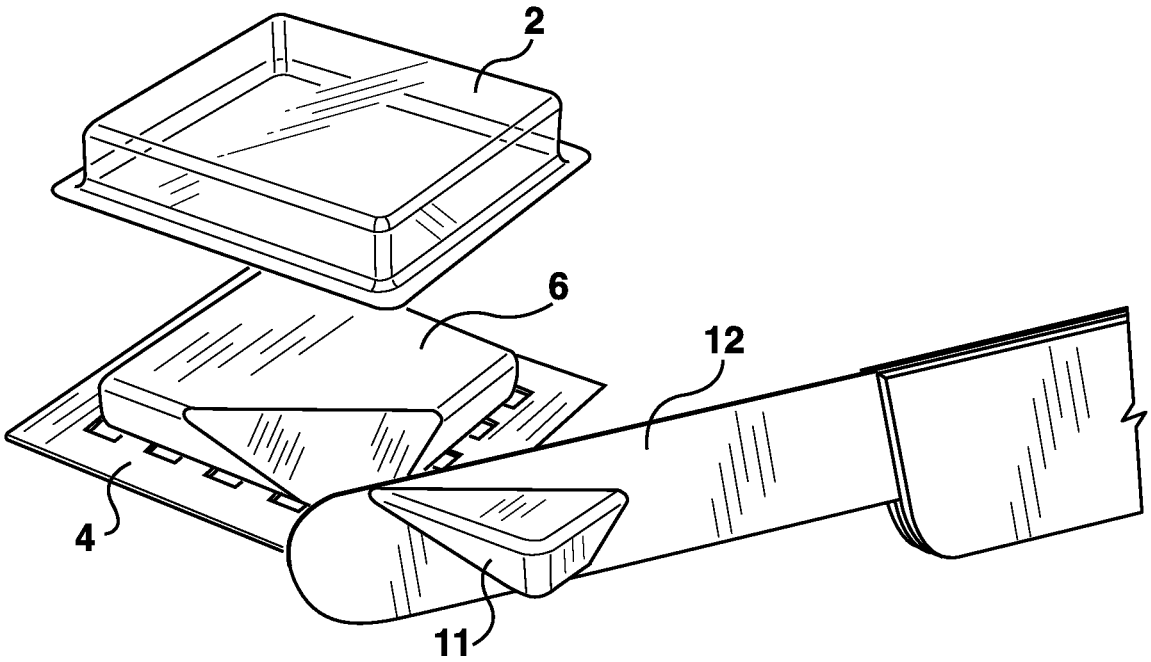
FIG. 18 is a perspective view of the top of a spreading device in accordance with the present invention when in use with the container removed.
Figure 19:
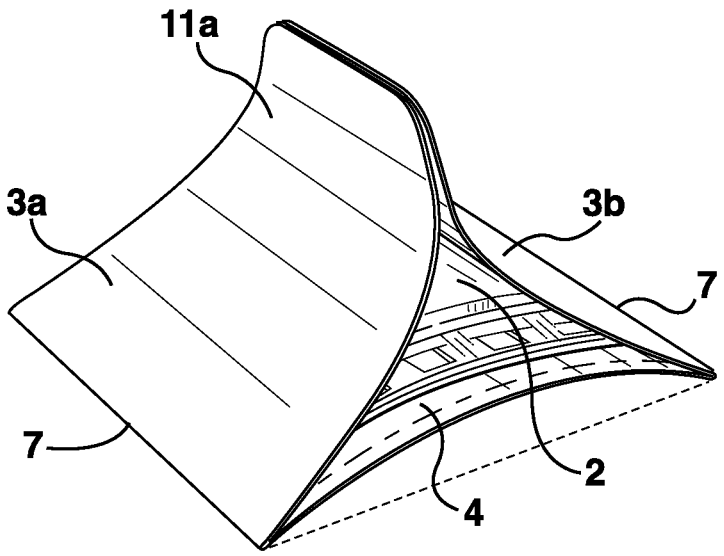
FIG. 19 is a perspective view of the top of the spreading device of FIG. 14 in accordance with the present invention when in a spreading position, but modified when in use relative to the depiction of FIG. 17.

In addition, the single, unitary component comprising the gripping or handling surfaces 3*a*, 3*b* and the filter 4 as depicted in FIGS. 14-19 may be bendable or flexible. For example, and as particularly depicted in FIG. 19, the normal resting position of the filter 4 is a flat position as indicated by the stippled line. However, when in use, the filter 4 may bend or flex as shown in FIG. 19, particularly where a surface that the spreadable substance is to be applied to is somewhat round, such as a cob of corn.

Application of the spreadable substance 6 to a surface will now be described based on the spreading device depicted in FIGS. 1-6. The gripping or handling surfaces 3*a* and 3*b* are held together by a user such that they are squeezed together, and such squeezing may apply pressure on the exterior surface of container 2. Pressure on the exterior surface of container 2 may in turn force the spreadable substance 6 to abut filter 4 and/or be expelled from the container 2 through openings of the filter 4. Having flexible or bendable gripping or handling surfaces 3*a* and 3*b* may assist with the above-described squeezing and/or pressuring.

With respect to application of the spreadable substance onto a desired surface, the filter 4 may be pressed against or placed near a surface so that the spreadable substance 6 is deposited onto such surface. With respect to the example of the spreadable substance 6 comprising butter, and the desired surface comprising a hot cob of corn, placing the filter 4 at the surface of the corn may cause the butter to at least partially melt and pass or flow through the filter and be deposited on the corn. Downward pressure on the container 2 by a user handling the gripping or handling surfaces 3*a* and 3*b* may assist with the depositing of the spreadable substance on the desired surface. Depending on the nature of the spreadable substance and the temperature of the desired surface or surrounding environment, it may or may not be necessary to apply pressure to the container 2 using the gripping or handling surfaces 3*a* and 3*b*, or otherwise, in order for the spreadable substance to pass through the filter 4.

Additionally, the spreading device may be handled in such a manner so as to spread the spreadable substance 6 on the desired surface. For example, the spreading device may be moved back and forth along the length of a cob of corn as shown in FIG. 6 in order to assist with spreading butter. Use of filter 4 may minimize the chances of an undesirable or excessive amount of the spreadable substance 6 unintentionally falling out of or being expelled from the container 2.

After use, the spreading device can be configured into the storage position, which may facilitate sanitary, easy, mess-free and/or compact clean-up or disposal.

Although the spreading device depicted in FIGS. 1-6 includes two gripping or handling surfaces (namely, 3*a* and 3*b*), it will be appreciated that the invention of the present disclosure may include spreading devices comprising a container and one gripping or handling surface. When such a spreading device is in the storage position, the gripping or handling surface at least partially covers the dispensing end of the container. When such spreading device is in the spreading position, the gripping or handling surface may cover at least a portion the top of the spreading device. Preferably, the gripping or handling surface may cover at least a portion the top of the container. In this spreading position, a user may simultaneously grasp or hold the spreading device and apply pressure to the exterior surface of the container, which in turn may cause the spreadable substance to be deposited on a desired surface in a manner as more particularly described above.

The above description regarding application of the spreadable substance 6 to a surface based on the spreading device depicted in FIGS. 1-6 also applies generally to the spreading devices depicted in FIGS. 7-19.

The spreading device of the present disclosure can be provided as either a single-spread or disposable device, or as a multiple-spread, re-fillable or re-usable device. The disposable spreading device may be made of one or more disposable materials, which may include one or more plastic or paper materials. Preferably, the disposable materials are biodegradable and/or recyclable. With respect to the re-usable spreading device, materials for the device's various components preferably may be selected so as to be sufficiently robust to withstand multiple uses and/or post-use cleanings.

Moreover, the filter 4 and/or the container 2 of a re-usable spreading device may be removably attached to the spreading device (either partially or fully removable in this regard) at the dispensing end or outlet of the container. Allowing such components to be removable enables re-filling the container 2 with a spreadable substance. In addition, allowing the container 2 to be removable enables access to the spreadable substance 6 in the event that a user prefers to apply the spreadable substance 6 to a surface using a knife or means that is other than through the filter 4. For example, the spreading device of FIGS. 14-18 depict a removable container 2. In particular, as depicted in FIG. 18, container 2 may be removed (such as for example by way of peeling the container 2) from the spreading device thus exposing spreadable substance 6 for access by a user. In this regard, a user may retrieve a portion 11 of the spreadable substance 6 using, for example, a knife 12. Providing the ability to access the spreadable substance 6 directly and without having to pass through the filter 4 may be advantageous for applying the spreadable substance to certain surfaces. For example, applying butter to broccoli or corn may in some cases be more efficient using a knife or other utensil than using the filter 4. If after removal of the container 2 a user has not retrieved all of the spreadable substance 6 from the spreading device and wishes to save or preserve any remaining amount of the spreadable substance 6, the user may re-attach the container 2 to the spreading device. It would be understood that such re-attaching may be accomplished in a number of ways. For example, the surface of the spreading device and/or the container 2 may have a sticker or adhesive thereon. Alternatively, physical or structural means (for example, tongue and groove) may be incorporated to allow for re-attachment of the container 2 to the spreading device.

With respect to construction of the spreading device, injection molding may be used for one or more of the components described above. In addition, tack welding may be used where appropriate. For example, plastic tack welding may be used to secure one or more components together to form the spreading device 1. Particularly, plastic tack welding may be used to permanently secure the filter 4 to the gripping or handling surfaces 3*a*, 3*b* and/or the container 2 at the dispensing end or outlet of the container. Furthermore, it may be possible to use die cutting such as extrusion die cutting to form, for example, the gripping or handling surfaces or wings 3*a*, 3*b* of FIGS. 1-6, or the single, unitary component comprising the gripping or handling surfaces 3*a*, 3*b* and the filter 4 of FIGS. 14-19.

With respect to the container 2 depicted in the various Figures, it has been depicted as being transparent. Such a transparent depiction may be possible in practice, and permits one reviewing the Figures to have a better view of surrounding structure and components than if the container 2 was depicted as non-transparent. Nevertheless, in actual practice it may be preferable and/or required pursuant to law, regulation or otherwise that the container be non-transparent or otherwise be such that the direct and/or diffused transmission of light through the container 2 does not exceed a certain threshold.

Figure 20:
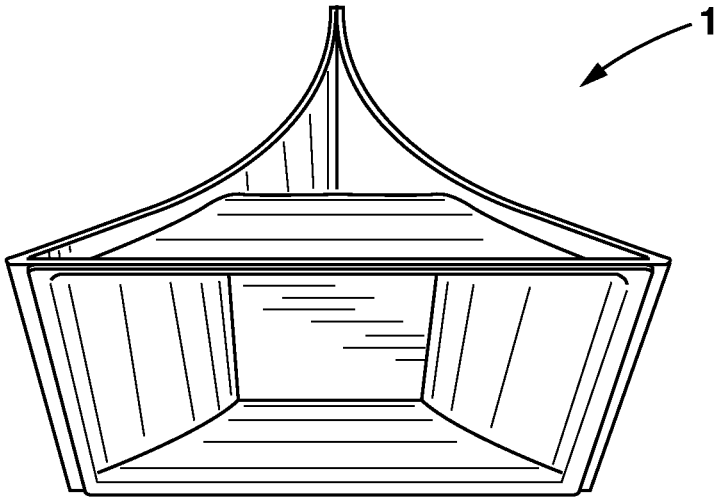
FIG. 20 is a perspective view of the bottom of a spreading device in accordance with the present invention when in a spreading position and with no grate or filter.

In some implementations of the present disclosure there is no grate or filter 4. For example where the spreadable substance 6 is applied to a delicate surface (e.g., a delicate pastry), the grate or filter 4 may damage the delicate surface. In these applications, it may be preferable to have the dispensing end open to the spreadable substance 6 when the spreading device 1 is in the spreading position, as depicted in FIG. 20. Note that FIG. 20 does not depict the spreadable substance 6. Also, it will be understood by the skilled person that the dispending end of the spreading device 1 may be covered by a removable layer 5 (not shown in FIG. 20) when the spreading device 1 is not in use or is in storage.

Figure 21:
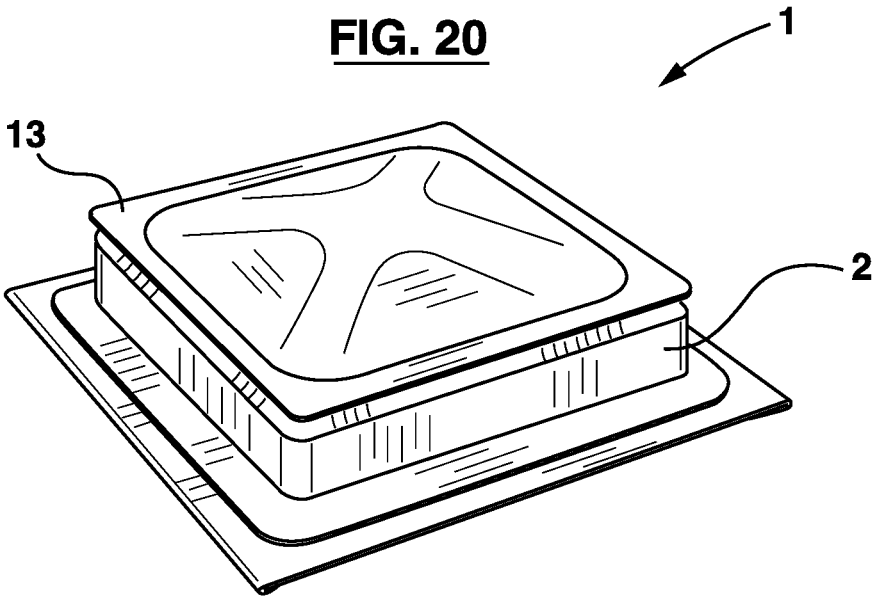
FIG. 21 is a perspective view of the top of a spreading device in accordance with the present invention when in a storage position and having a toppings pouch.
Figure 22:
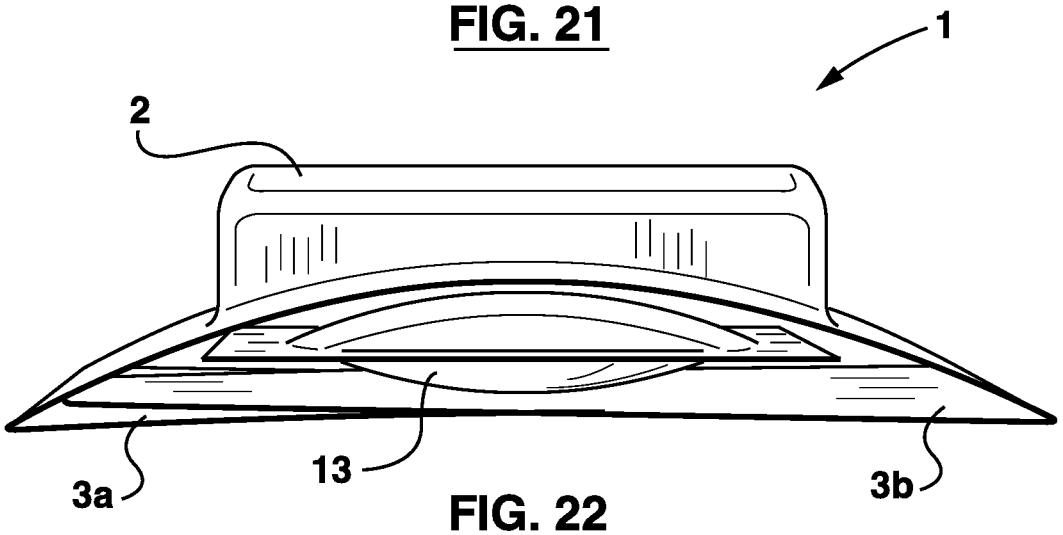
FIG. 22 is a perspective view of the top of a spreading device in accordance with the present invention when in a storage position and having a toppings pouch.

The spreading device of the present disclosure may also be provided with a toppings pouch 13, as depicted in FIGS. 21 and 22. The toppings pouch 13 may include a granular substance such as salt or pepper. The toppings pouch 13 may also or alternatively include a second spreadable substance complimentary to the spreadable substance 6. For example, if the spreadable substance 6 is peanut butter, the toppings pouch 13 may contain either jam or honey. When such a spreading device is in use, the toppings pouch 13 may be removed or separated from the spreading device, following which the second spreadable substance may be extracted from the toppings pouch 13 for application to a desired surface. Depending on the preferences of a user, the spreading device may be used to simultaneously apply the spreadable substance 6 to the desired surface and mix and/or spread both the spreadable substance 6 and the second spreadable substance from the toppings pouch 13. Alternatively, a user may separately apply the spreadable substance 6 to the desired surface and mix and/or spread the spreadable substance 6 and/or the second spreadable substance from the toppings pouch 13.

FIGS. 21 and 22 depict the spreading device with a toppings pouch 13 in the storage position. Such toppings pouch 13 may be coupled to the device in a manner that is complementary to the shape or contour of the device. More specifically, FIG. 21 depicts a device when in the storage position where the dispensing surface is flat and the toppings pouch 13 is fastened to the exterior surface of the container at the top of the container. Such fastening may be accomplished using an appropriate adhesive, such as an adhesive that may be of sufficient strength to keep the toppings pouch 13 fastened during typical storage and/or transportation conditions, while at the same time not being too strong so as to prevent a user from separating the toppings pouch 13 from the container in order to use the device. Alternative fastening means are possible as well, including mechanical fastening (e.g., a toppings pouch that is mechanically attached to the device and may be torn off along a perforated edge). Where the dispensing surface is flat, the toppings pouch 13 does not necessarily have to be fastened to the top of the container; it may alternatively be located under the dispensing surface, either between the dispensing surface and the at least one gripping or handling surface, or outside the at least one gripping or handling surface. FIG. 22 depicts a device when in the storage position where the dispensing surface is concave and the toppings pouch 13 is fastened, wedged or located between the gripping or handling surfaces 3*a*, 3*b* and the concave dispensing surface.

Figure 23:
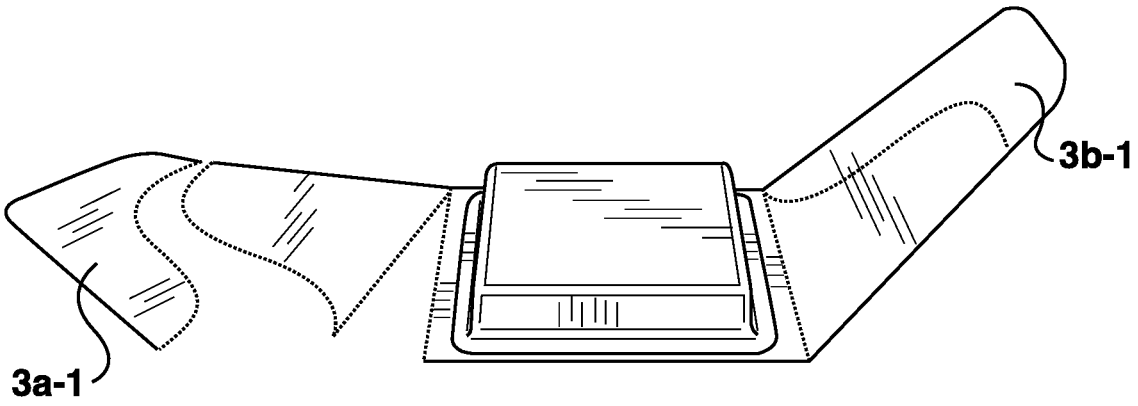
FIG. 23 is a perspective view of the top of a spreading device in accordance with the present invention and having functional tear-offs.

The spreading device of the present disclosure may also be provided with gripping or handling surfaces 3*a*, 3*b* that are perforated such that one or both of gripping or handling surfaces 3*a*, 3*b* may be converted or separated into functional tear-offs. As shown in FIG. 23, the functional tear-offs 3*a*-1, 3*b*-1 may be used as spreading knifes when separated from the device. Other configurations for functional tear-offs, although not shown, are contemplated, including but not limited to skewers, scoops/spoons and forks.

Figure 24A:
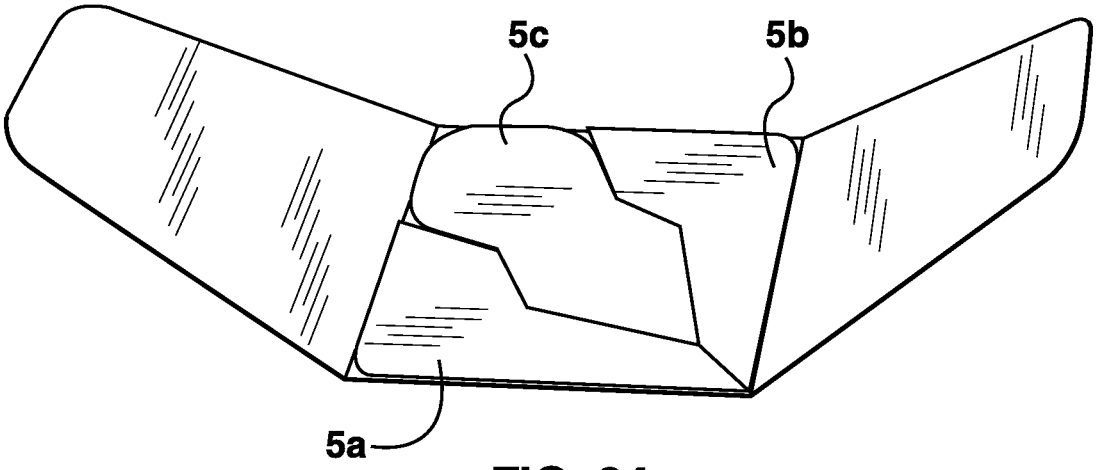
FIG. 24*a* is a perspective view of the bottom of a spreading device in accordance with the present invention having functional tear-offs and when the functional tear-offs are not separated.
Figure 24B:
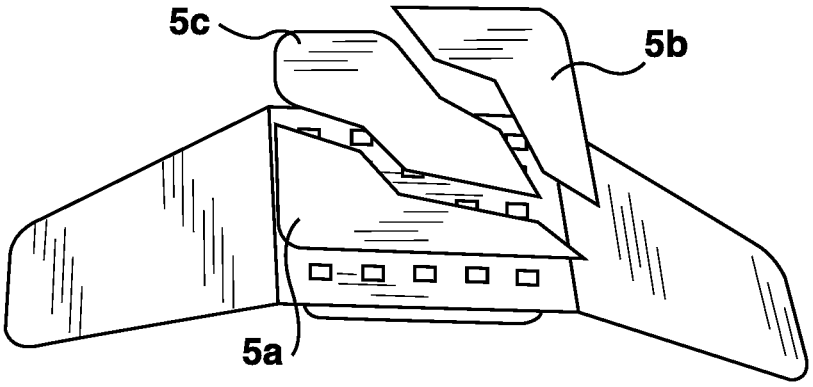
FIG. 24*b* is a perspective view of the spreading device of FIG. 24*a* when the functional tear-offs are separated.

Alternatively, or additionally, the removable layer 5 may be perforated such that it may be converted or separated into functional tear-offs. As shown in FIGS. 24*a* and 24*b*, the functional tear-offs 5*a*, 5*b* may be used as skewers, such as for corn, and the functional tear-off 5*c* may be used as a knife, such as a spreading knife. When the removable layer 5 is convertible or separable into functional tear-offs, it may correspondingly be constructed of a more robust or rigid material, such as relatively thicker plastic, as opposed to a sticker or other thin adhesive material. Such more robust or rigid material may nevertheless comprise a sticker or other adhesive surface for affixing to the filter of the device, thus maintaining a contamination barrier for the contents of the container.

FIGS. 1-24 depict a container 2 that is generally shaped as a rectangular prism. However, the present invention is not so limited and the container 2 may be provided in various shapes to suit desired applications or preferences. Further container examples are depicted in FIGS. 25-29.

Figure 25A:
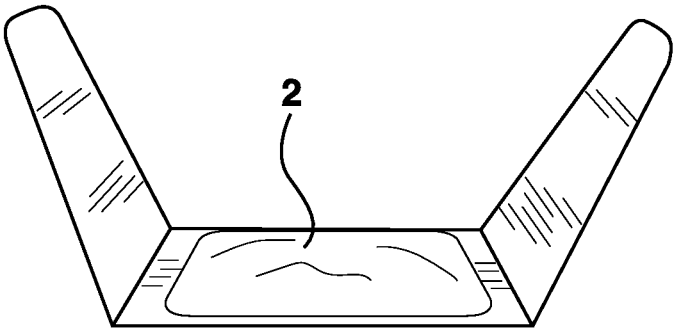
FIG. 25*a* is a perspective view of the top of a spreading device in accordance with the present invention.
Figure 25B:
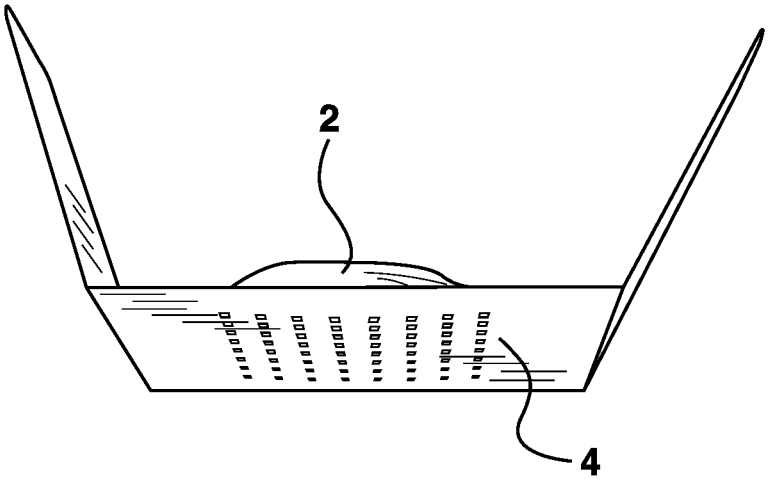
FIG. 25*b* is a perspective view of the bottom of the spreading device of FIG. 25*a* with a grate or filter covering the dispensing end of the container.
Figure 25C:
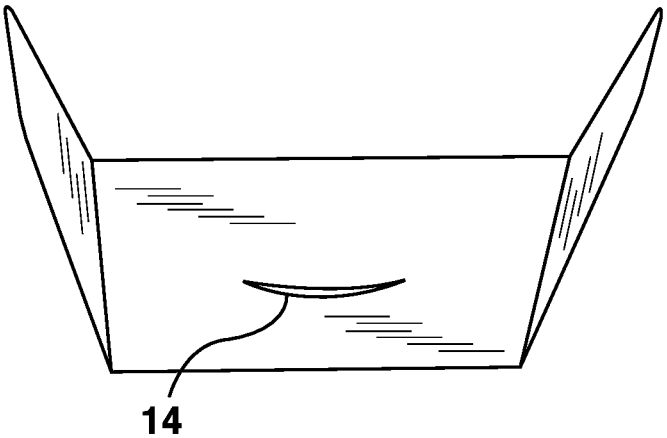
FIG. 25*c* is a perspective view of the bottom of the spreading device of FIG. 25*a* with the dispensing end fully covered except for a slit opening.

In particular, there may be instances where the material forming the container 2 may be prescribed pursuant to law, regulation or otherwise, such as a layered combination of aluminum and plastic for certain pharmaceutical creams. In this regard, FIG. 25 depicts a device comprising a spreading substance that is a pharmaceutical or other cream and a container 2 that may be formed of a soft plastic or a layered combination of aluminum and plastic. Such container 2 may be generally shaped or take on a shape based on its contents. FIG. 25*b* depicts the spreading device of FIG. 25*a* with a grate or filter 4. FIG. 25*c* depicts an alternative embodiment of the present disclosure where the dispensing end of the container 2 is fully covered except for a slit opening 4. For certain spreadable substances 6, such as certain pharmaceutical creams, the slit 14 may allow for more effective application to the spreading surface. However, the devices depicted in FIGS. 25*a*-25*c* are not limited to pharmaceutical creams and may be preferred for other edible, non-edible, or granular spreadable substances 6. Moreover, the particular configurations of the grate or filter 4, and the slit 14 may vary. For example, the number and size of holes for the grate or filter 4 may vary depending on the particular substance in the container 2. In addition, there may be more than one slit 4 located at the dispensing end, and such slits may be located separate to one another or overlapping one another (such as two slits that criss-cross one another). The grate or filter 4 and the one or more slits may be sealed prior to use with a removable layer. With respect to the slits, they may alternatively or additionally be closed or sealed until a user is ready to use the device. When ready to use the device, a user may be able to access the contents of the container by puncturing or opening the one or more previously closed slits.

Figure 26:
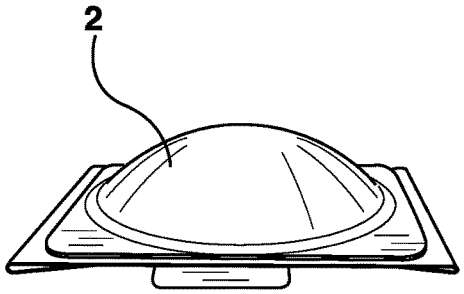
FIG. 26 is a perspective view of the top of a spreading device in accordance with the present invention and having a dome-shaped container.

FIG. 26 is depicts a dome-shaped container 2.

Figure 27:
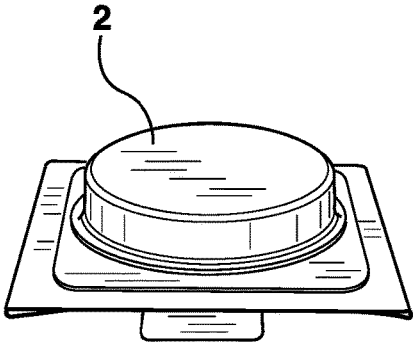
FIG. 27 is a perspective view of the top of a spreading device in accordance with the present invention and having a cylindrical container.

FIG. 27 depicts a cylindrical container 2.

Figure 28:
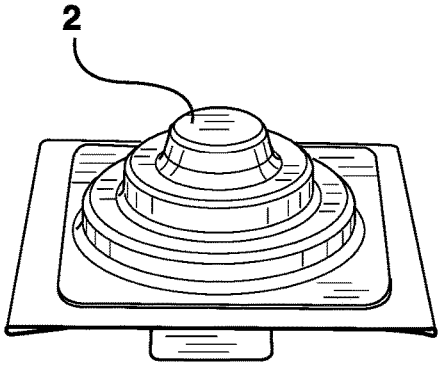
FIG. 28 is a perspective view of the top of a spreading device in accordance with the present invention and having a container shaped with collapsible concentric cylinders.

FIG. 28 depicts a container 2 comprising collapsible concentric cylinders.

Figure 29A:
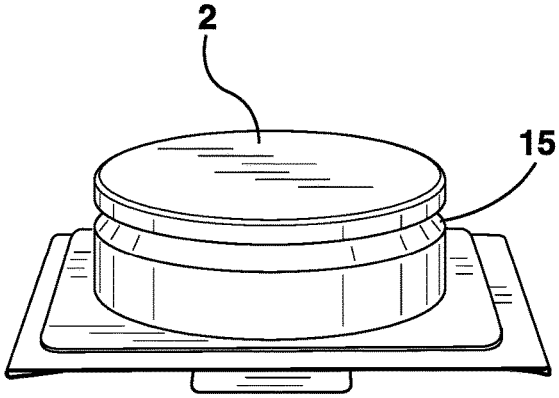
FIG. 29*a* is a perspective view of the top of a spreading device in accordance with the present invention having a cylindrical container with a ridge extending into the container.
Figure 29B:
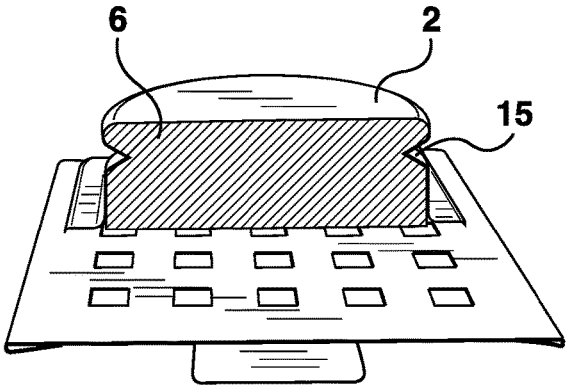
FIG. 29*b* is a perspective cross-sectional view of the container portion of the spreading device of FIG. 29*a*.

FIGS. 29*a* and 29*b* depict a cylindrical container 2 with a ridge 15 extending into the container. Such a ridge may improve the grip or retention of the spreadable substance 6 when the spreadable substance 6 may otherwise fall or slide out of the container in whole or in part. Such ridges may be created as a result of compression of the container. For example, in the case of a plastic container, it may be compressed, and where relatively thin plastic is employed, more consistent ridges may be achievable from compression. In such a situation, there may be no need for an injection molded undercut in order to construct a container with a ridge. The skilled person will understand that other container shapes may be employed within the scope of the present invention.

The spreading device 1 of the present disclosure may also be provided with an embedded electronic component, such as an RFID component, to track the shelf-life of the spreadable substance 6.

While various exemplary embodiments have been presented in the foregoing detailed description, it should be appreciated that other variations may exist. It should also be appreciated that the exemplary embodiments are only examples, and are not intended to limit the scope, applicability or configuration of the disclosure in any way. Rather, the foregoing detailed description will enable those skilled in the art to implement an exemplary embodiment of the disclosure, it being understood that various changes may be made in the function and arrangement of elements described in an exemplary embodiment without departing from the scope of the invention as set forth in the appended claims. That is, the scope of the appended claims should not be limited by the preferred embodiment set forth in the examples, but should be given the broadest interpretation consistent with the description as a whole.

What is claimed is:

1. A spreading device comprising:

a container for containing a spreadable substance, the container comprising a dispensing end at a bottom surface thereof through which the spreadable substance is dispensed; and a first gripping or handling surface and a second gripping or handling surface extending from the container in opposite directions and configured to be bent, flexed, pivoted, or folded between:

a storage position, wherein at least one gripping or handling surface of the first and second gripping or handling surfaces at least partially covers the dispensing end of the container; and a spreading position, wherein at least a portion of the at least one gripping or handling surface contacts at least a portion of a top surface of the container opposite the dispensing end.

2. The spreading device of claim 1 wherein the first gripping or handling surface and the second gripping or handling surface at least partially contact one another when in the spreading position.

3. The spreading device of claim 1, wherein the first and second gripping or handling surfaces comprise one or more bendable or flexible points, folding or pivoting edges, or hinges.

4. The spreading device of claim 1, wherein the first and second gripping or handling surfaces comprise one or more functional tear-offs.

5. The spreading device of claim 1, wherein the dispensing end of the container forms a substantially flat surface.

6. The spreading device of claim 1, wherein the dispensing end of the container forms a concave surface.

7. The spreading device of claim 1, further comprising a removable layer substantially covering the dispensing end of the container.

8. The spreading device of claim 1, further comprising a filter that at least partially covers the dispensing end of the container.

9. The spreading device of claim 8 wherein the filter comprises a slit.

10. The spreading device of claim 8 wherein the filter comprises a plurality of holes or apertures.

11. The spreading device of claim 8 wherein the filter comprises a plurality of bristles.

12. The spreading device of claim 1, further comprising the spreadable substance wherein the spreadable substance is edible.

13. The spreading device of claim 1, further comprising the spreadable substance wherein the spreadable substance is non-edible.

14. The spreading device of claim 1, wherein the container is removable from and re-attachable to the spreading device.

15. The spreading device of claim 14 wherein the container when attached to the spreading device is attached using one or more of the following: tongue and groove; and, sticker and/or adhesive.

16. The spreading device of claim 1, wherein the container is cylindrical and comprises a concentric ridge extending into the container.

17. The spreading device of claim 1, further comprising a toppings pouch fastened to the container.

18. The spreading device of claim 1, wherein the first gripping or handling surface and the second gripping or handling surface at least partially cover or overlap one another when in the storage position.

19. The spreading device of claim 1, wherein the container is formed of a flexible, compressible, or bendable material, and when in the spreading position the at least one gripping or handling surface applies pressure against the container to cause the spreadable substance to dispense out of the dispensing end of the container.

20. A spreading device comprising:

a container for containing a spreadable substance, the container comprising a dispensing end at a bottom surface thereof through which the spreadable substance is dispensed;

a removable layer substantially covering the dispensing end of the container; and at least one gripping or handling surface extending from the container and configured to be bent, flexed, pivoted, or folded between:

a storage position, wherein the at least one gripping or handling surface at least partially covers the dispensing end of the container; and a spreading position, wherein at least a portion of the at least one gripping or handling surface contacts at least a portion of a top surface of the container opposite the dispensing end.

21. A spreading device comprising:

a container for containing a spreadable substance, the container comprising a dispensing end at a bottom surface thereof through which the spreadable substance is dispensed; and at least one gripping or handling surface extending from the container and configured to be bent, flexed, pivoted, or folded between:

a storage position, wherein the at least one gripping or handling surface at least partially covers the dispensing end of the container; and a spreading position, wherein at least a portion of the at least one gripping or handling surface contacts at least a portion of a top surface of the container opposite the dispensing end, wherein the container is formed of a flexible, compressible, or bendable material, and when in the spreading position the at least one gripping or handling surface applies pressure against the container to cause the spreadable substance to dispense out of the dispensing end of the container.

* * * * *